US010196224B2

(12) United States Patent
Balcan et al.

(10) Patent No.: US 10,196,224 B2
(45) Date of Patent: Feb. 5, 2019

(54) MEDIA LOAD DAMPER GUIDE FOR PRINTERS

(75) Inventors: Petrica Dorinel Balcan, Thousand Oaks, CA (US); David Garbe, Ventura, CA (US); Alexander Peter, Van Nuys, CA (US)

(73) Assignee: ZIH Corp., Lincolnshire, IL (US)

( * ) Notice: Subject to any disclaimer, the term of this patent is extended or adjusted under 35 U.S.C. 154(b) by 566 days.

(21) Appl. No.: 13/294,849

(22) Filed: Nov. 11, 2011

(65) Prior Publication Data

US 2012/0119011 A1 May 17, 2012

Related U.S. Application Data

(60) Provisional application No. 61/413,192, filed on Nov. 12, 2010.

(51) Int. Cl.
*B65H 23/16* (2006.01)

(52) U.S. Cl.
CPC ..... *B65H 23/16* (2013.01); *B65H 2402/542* (2013.01); *B65H 2515/312* (2013.01); *B65H 2601/511* (2013.01); *B65H 2801/12* (2013.01)

(58) Field of Classification Search
CPC ..... B65H 23/16; B65H 23/26; B65H 23/025; B65H 23/0251; B65H 23/0256; B65H 23/022; B65H 2301/413; B65H 2301/41306; B65H 2301/41308; B65H 2301/4134; B65H 2402/542; B65H 2515/312; B65H 2601/524
USPC ... 242/566, 615, 615.1, 615.2, 417.3, 418.1; 226/90, 118.3
See application file for complete search history.

(56) References Cited

U.S. PATENT DOCUMENTS

| | | | | |
|---|---|---|---|---|
| 3,540,674 | A * | 11/1970 | Okamura | 242/147 R |
| 5,041,845 | A * | 8/1991 | Ohkubo et al. | 346/24 |
| 5,320,437 | A * | 6/1994 | Malke et al. | 400/605 |
| 5,386,772 | A * | 2/1995 | Tolle et al. | 101/248 |
| 5,685,471 | A * | 11/1997 | Taubenberger | 242/615.1 |
| 6,068,419 | A * | 5/2000 | Shiozaki et al. | 400/582 |
| 6,164,641 | A * | 12/2000 | Harada | B65H 3/46 271/114 |
| 6,352,257 | B1 * | 3/2002 | Todaro et al. | 271/268 |
| 6,540,170 | B2 * | 4/2003 | Tipton | B65B 13/184 242/421.8 |
| 6,547,707 | B2 * | 4/2003 | Cote | 493/13 |
| 7,036,923 | B2 * | 5/2006 | Takagi | B41J 15/048 226/170 |
| 2004/0140387 | A1 * | 7/2004 | Ishida et al. | 242/417.3 |

* cited by examiner

*Primary Examiner* — Michael R Mansen
*Assistant Examiner* — Nathaniel L Adams

(57) ABSTRACT

Embodiments of the present invention are related to a media transport assembly for printers, such as a kiosk printer. The media transport assembly may comprise a biased guide roller structured to dampen media tension shocks, discontinuities, or variations. Other embodiments of the present invention may also provide a media transport assembly configured to allow increased flexibility in media supply roll mounting and for easy loading and threading of the media.

14 Claims, 6 Drawing Sheets

MEDIA LOAD DAMPER GUIDE FOR PRINTERS

CROSS REFERENCE TO RELATED APPLICATIONS

This application claims the benefit of U.S. Provisional Application No. 61/413,192, filed Nov. 12, 2010, which is hereby incorporated by reference.

FIELD

Embodiments of the invention relate to printers. In particular, some embodiments of the invention relate to media loading and handling components for printers.

BACKGROUND

Printers may be used in a variety of applications and may employ multiple differing printing technologies. For example, printers may be used for barcode printing, card printing, mobile printing, and kiosk printing applications while employing inkjet, direct thermal, thermal transfer, and intermediate thermal transfer printing technologies.

Applicant has identified a number of deficiencies and problems associated with the use, operation, and performance of conventional printers and, more particularly, with various media handling components of the same. Through applied effort, ingenuity, and innovation, Applicant has solved many of these identified problems by developing a solution that is embodied by the present invention, which is described in detail below.

BRIEF SUMMARY

Embodiments of the present invention may provide an improved media handling system, and in particular, an improved media transport assembly configured to mitigate variations in tension load on the media.

An example embodiment of the present invention may include a media transport assembly configured to transport media under a tension load. The media transport assembly may include a biased guide roller configured to apply a biasing force to the media, where the biased guide roller may be configured to move against the biasing force in response to variations of the tension load. The biased guide roller may be moved against the biasing force in response to an increase in the tension load. The media transport assembly may also include a top guide roller positioned above the media path and a bottom guide roller positioned below the media path.

The media transport assembly of example embodiments may also include a hinged access assembly that is rotatably movable between an open position and a closed position relative to a base member. The biased guide roller and the top roller may be mounted to the hinged access assembly. The hinged access assembly may be retained in the closed position by a latch mechanism. The media transport assembly may also include a stationary roller, where the biased guide roller may be located between the bottom guide roller and the stationary guide roller. A media feed path may be defined along a top side of the bottom guide roller, a bottom side of the biased guide roller, and a top side of the stationary guide roller. The media feed path may be substantially U-shaped when the biased guide roller is in a retracted position.

Example embodiments of the present invention may include a media transport assembly that is configured to transport media drawn from a media supply roll to a media path, the media supply roll being positioned in either a first position above the media path or a second position below the media path. The media transport assembly may include a top guide roller positioned above the media path, where the top guide roller may be configured to engage and direct the media to the media path from the supply roll in response to the supply roll being disposed in the first position. The media transport assembly may also include a bottom guide roller positioned below the media path, where the bottom guide roller may be configured to engage and direct the media to the media path from the supply roll in response to the supply roll being disposed in the second position.

Media transport assemblies according to example embodiments may include a hinged access assembly rotatably movable between an open position and a closed position relative to a base member, where the top guide roller may be attached to the hinged access assembly and where the bottom guide roller may be attached to the base member. The media transport assembly may also include a biased guide roller configured to apply a biasing force to the media and where the biased guide roller may be configured to move against the biasing force in response to variations of a tension load of the media. The biased guide roller may be attached to the hinged access assembly.

Further example embodiments of the present invention may include a media transport assembly configured to transport media under a tension load. The media transport assembly may include a hinged access assembly that is rotatably movable between an open position and a closed position, wherein the hinged access assembly includes a biased guide roller that is configured to apply a biasing force to the media when the hinged access assembly is disposed in the closed position, and where the biased guide roller is configured to move against the biasing force in response to variations in the tension load. The biased guide roller may be spaced apart from the media when the hinged access assembly is disposed in the open position.

Example embodiments of a media transport assembly according to the present invention may include a top guide roller and a bottom guide roller, where the top guide roller may be attached to the hinged access assembly. The media transport assembly may also include a stationary roller, where a media feed path may be defined between the top guide roller and the bottom guide roller, below the biased guide roller, and above the stationary guide roller. The top guide roller may be attached to the hinged access assembly. The bottom guide roller and the stationary guide roller may be attached to a base member of the media transport assembly. The media feed path may be defined between the hinged access assembly and the base member. The hinged access assembly may be maintained in the closed position with a latch mechanism.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Various embodiments of the present invention are directed to providing improved media handling components (e.g., media transport assemblies, media guide rollers, etc.) for printers. While the disclosed improvements may be used in any type of printer, the foregoing description describes such improvements in connection with kiosk printers simply for illustration purposes.

A variety of applications exist for publicly-used, stand-alone printers, or so-called "kiosk printers." These include printing of receipts at gas pumps, automatic teller machines (ATMs), and self-service checkout locations at retail stores, amongst others. Kiosk printers are generally constructed to advance a web of continuous print media through a nip defined between a printhead and platen for printing and to advance a printed web portion further downstream for presentation to a user. The printed web portion may be torn-off by the user or cut from the remainder of the media roll.

Figure 1:
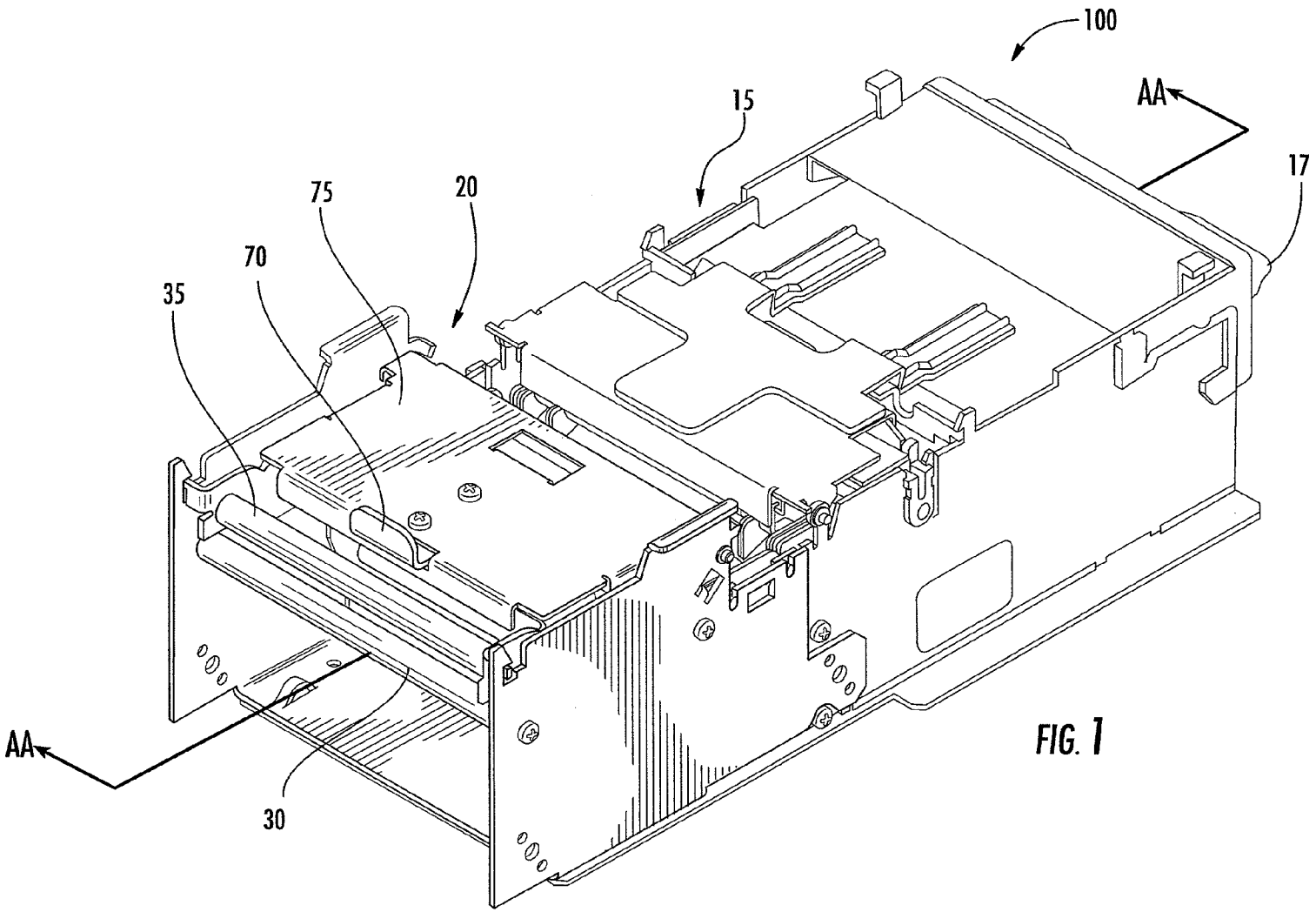
FIG. 1 is a perspective view of a printer structured in accordance with various embodiments discussed herein.

FIG. 1 illustrates a printer 100 structured in accordance with various embodiments of the present invention. The depicted printer 100 comprises a printing assembly 15 and a media transport assembly 20, where the media transport assembly is configured to convey media to the printing assembly for processing. A web of media (not shown) is fed between a top guide roller 35 and a bottom guide roller 30 into the media transport assembly 20. The media is pulled through the media transport assembly 20 by a motor (not shown) configured to drive a platen (not shown) or other drive roller housed within the printing assembly 15. In the depicted embodiment, the media is drawn from a media supply roll, maneuvered through the media transport assembly 20, fed into the printing assembly 15 for printing, and presented to a user proximate the printing outlet 17.

As will be discussed below in accordance with FIGS. 5 and 6, the depicted printer 100 further comprises a hinged access assembly 75 that is configured to provide access to the media transport assembly 20 for reloading and/or threading the media and for accessing other internal printer components. In one embodiment, the hinged access assembly 75 comprises a handle or tab 70 that is configured to unlock or open the hinged access assembly 75 as discussed in greater detail below.

Figure 2A:
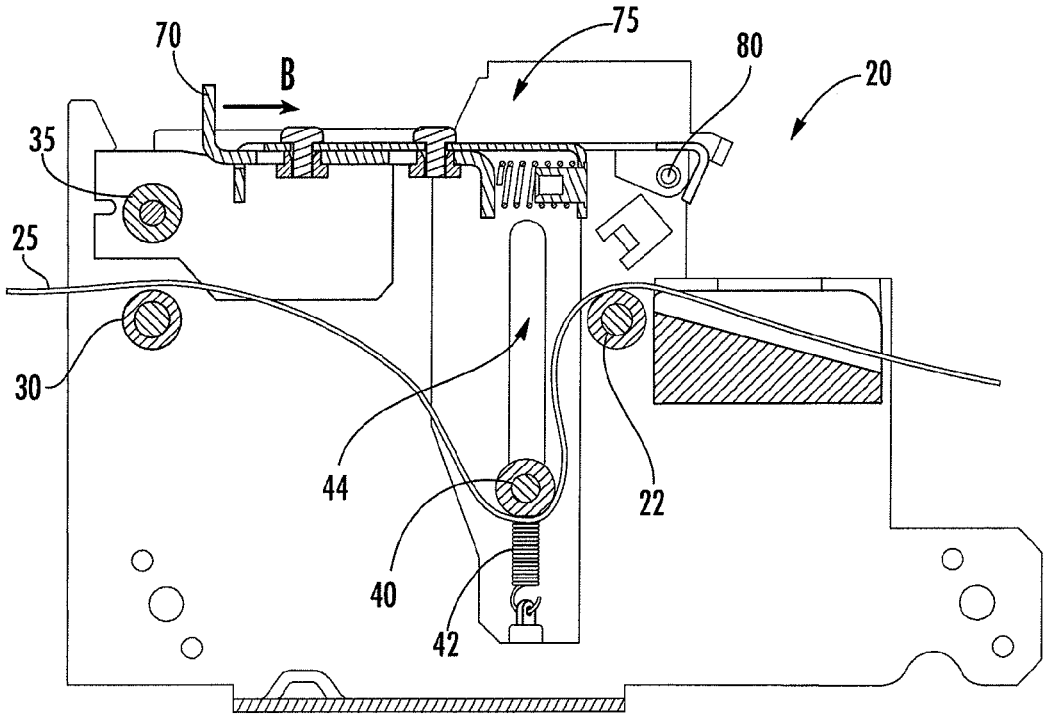
FIG. 2A is a section view of a media transport assembly of the printer of FIG. 1, taken along section line AA of FIG. 1, wherein a biased guide roller is disposed in a retracted position in accordance with one embodiment discussed herein.
Figure 2B:
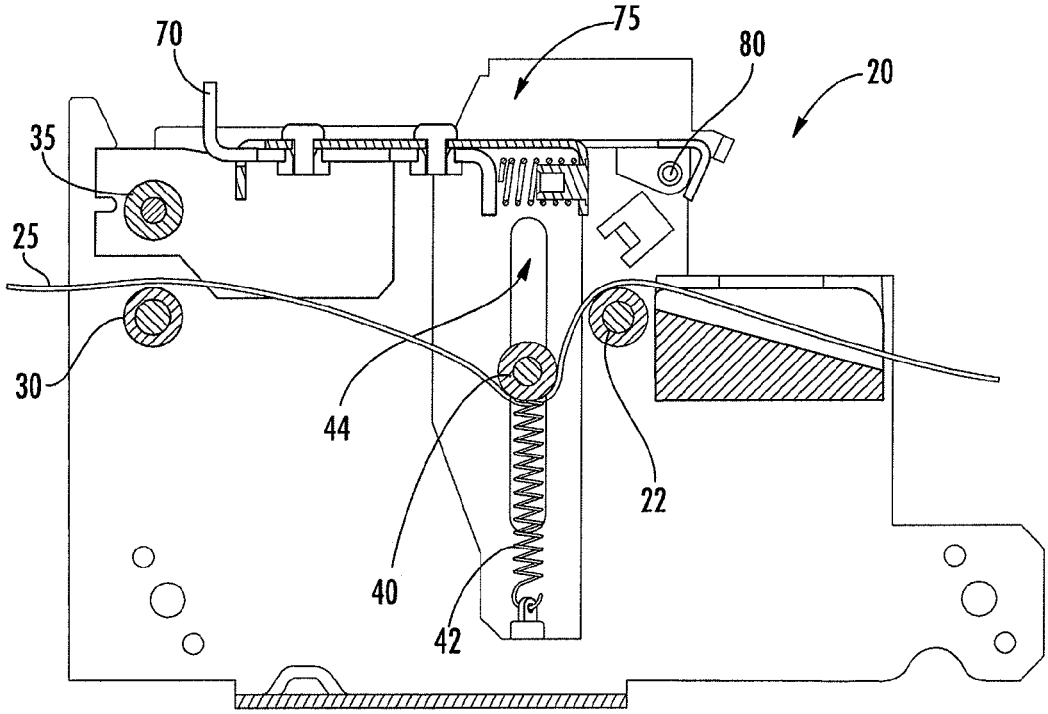
FIG. 2B is a section view of a media transport assembly of the printer of FIG. 1, taken along section line AA of FIG. 1, wherein the biased guide roller is disposed in an extended position in accordance with one embodiment discussed herein.

FIGS. 2A and 2B are section views of the printer 100 depicted in FIG. 1, taken along section line AA, to better illustrate a media transport assembly 20 structured in accordance with various embodiments of the invention. The depicted media transport assembly 20 comprises four guide rollers that are configured to maneuver the media 25 from a media supply roll (not shown) to the printing assembly 15 (shown in FIG. 1). More specifically, the media transport assembly 20 comprises a top guide roller 35, a bottom guide roller 30, a biased guide roller 40, and a stationary guide roller 22.

The biased guide roller 40 is attached to a biasing element such as the depicted spring 42 and is configured to move upwardly and downwardly within a slot 44. In the depicted embodiment, the spring 42 is connected to a fixed component of the printer 100 such as a base or frame and is biased to position the biased guide roller 40 away from the stationary guide roller 22 in a retracted position as shown in FIG. 2A (e.g., biased downwardly by the spring pulling the biased guide roller). The slot 44 may be within the base, frame, or other stationary component of the printer 100. The biasing spring 42 and slot 44 may be arranged at both ends of the guide roller 40 such that the guide roller 40 is supported at both ends within a respective slot and each end is biased by a spring 42 or other biasing element. Similarly, the top guide roller 35, bottom guide roller 30, and stationary guide roller 22 may each be supported at both ends within the base, frame, or other stationary component of the printer 100. The media 25 is fed between the top and bottom guide rollers 35, 30, around the biased guide roller 40, and over the stationary guide roller 22 to define a "U" shaped conveyance path as shown. The media feed path is defined along a top side of the bottom guide roller 30 (and/or along a bottom side of the top guide roller 35), along a bottom side of the biased guide roller 40, and along a top side of the stationary guide roller 22.

FIG. 2B illustrates how a media transport assembly 20 structured in accordance with various embodiments of the invention can dampen any shocks, discontinuities, or variations that might be associated with a tension force applied to the media 25 as it is pulled through the media transport assembly 20. As will be apparent to one of skill in the art in view of this disclosure, such shocks, discontinuities, or variations may be created in a variety of manners, such as by the platen drive motor providing uneven levels of torque. Further variations in the tension force applied to the media may result from the starting and stopping of media dispensing from a media roll. For example, the platen drive motor may be required to provide a first torque level in order to overcome the relatively high inertial load associated with drawing media from a large media supply roll and a second, relatively smaller, torque level for drawing media from the media supply roll once it has begun to rotate. Variations in the tension force on the media may cause printing defects or reduce the quality of the printed image by causing an inconsistent tension or speed of the media as it passes through the printing assembly 15, between the platen roller and the printhead.

FIG. 2B depicts the biased guide roller 40 disposed in an extended position, which may be caused by the biased guide roller 40 moving upwardly along the slot 44 against the bias of the spring 42 in response to a tension force applied to the web 25. In one embodiment, the bias of the spring 42 operates to dampen any shocks or discontinuities that might be encountered with regard to the applied tension force by moving the biased guide roller 40 upwardly or downwardly within the slot as may be needed. Such dampening advantageously allows the media web to be drawn through the printing assembly 15 (e.g., between the nip defined between the printhead and platen) under a more consistent tension or load thereby reducing printing defects (e.g., compressed or stretched printing, platen drive motor stalling, etc.) as will be apparent to one of ordinary skill in the art in view of this disclosure.

In the depicted embodiment, the spring 42 is a helical coil spring while in other embodiments differing springs or biasing elements may be used. In some embodiments, the spring 42 have may possess a spring stiffness between 0.5 lbs/inch to 1.5 lbs/inch for media supply rolls of 6 inches to 10 inches in diameter. However, in other embodiments, for example, in embodiments using larger or smaller media supply rolls, or larger or smaller platen drive motors, springs having a differing spring stiffness may be used to effectively dampen anticipated media tension shocks and discontinuities.

Figure 3:
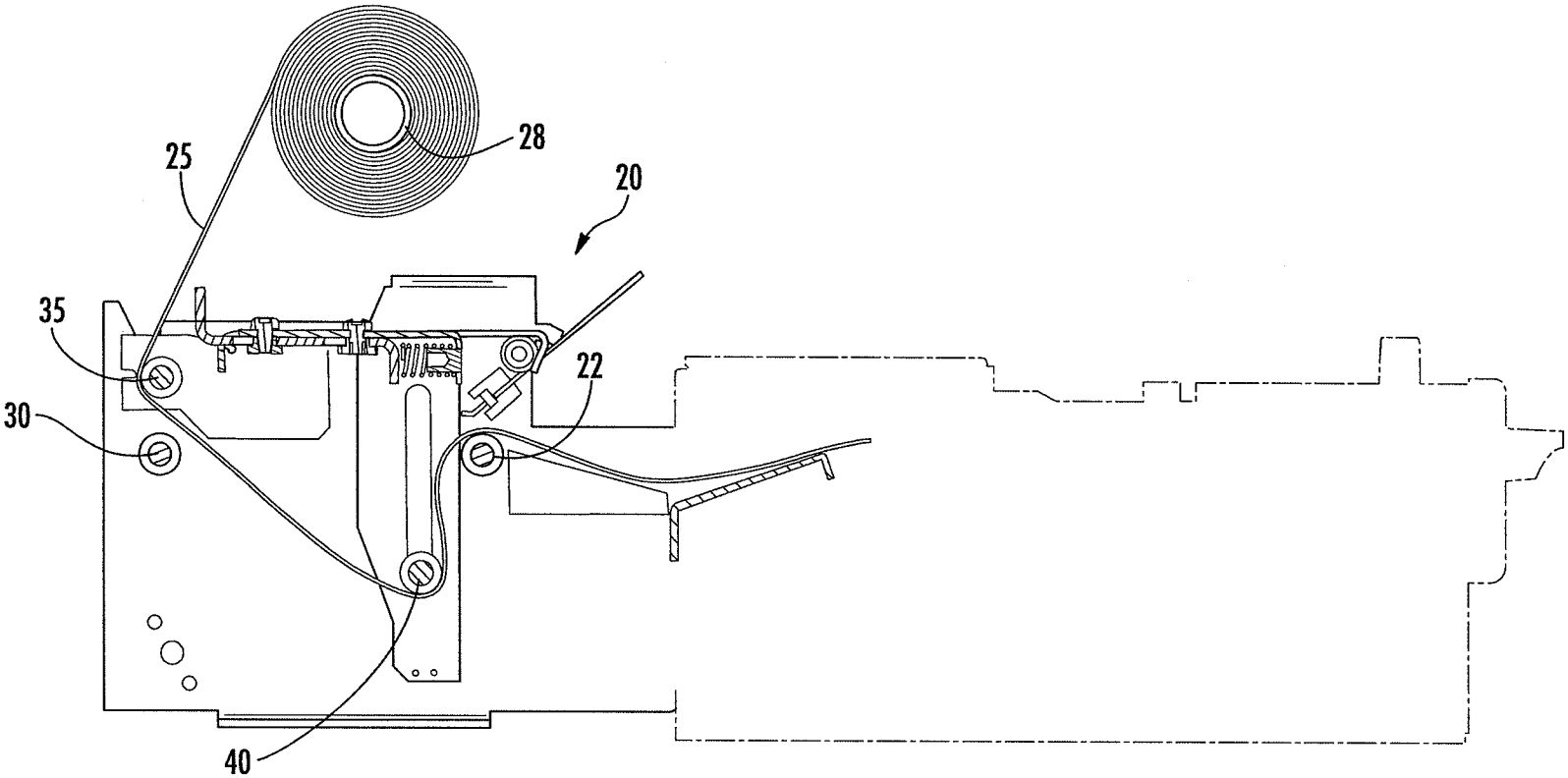
FIG. 3 is section view of a media transport assembly of the printer of FIG. 1, taken along section line AA of FIG. 1, wherein a media supply roll has been positioned in an elevated position in accordance with one embodiment discussed herein.
Figure 4:
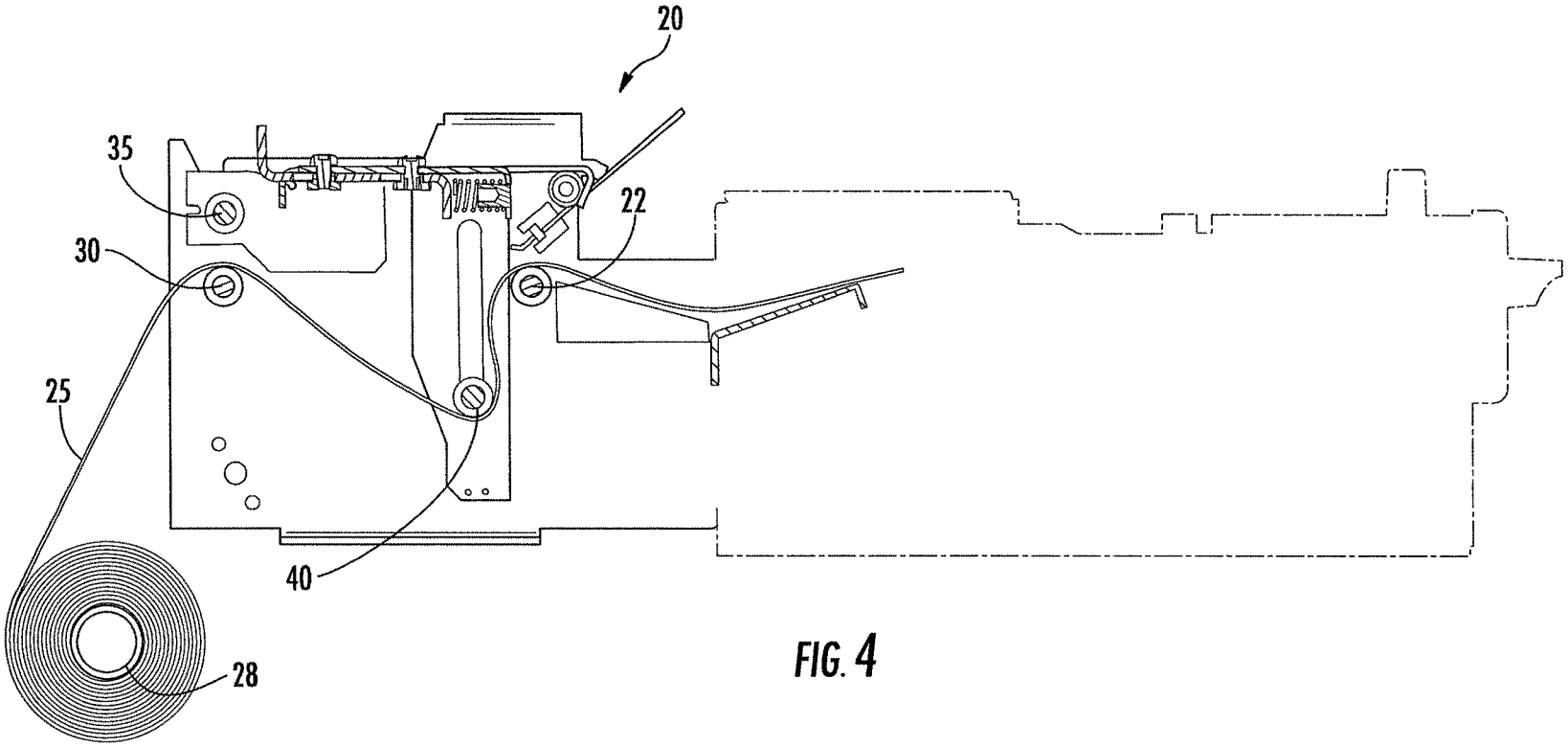
FIG. 4 is section view of a media transport assembly of the printer of FIG. 1, taken along section line AA of FIG. 1, wherein a media supply roll has been positioned in a lower position in accordance with one embodiment discussed herein.

FIGS. 3 and 4 illustrate another advantage to embodiments of the present invention. As noted above, the media 25 is fed between the top guide roller 35 and the bottom guide roller 30. In the depicted embodiment, the position and placement of the top guide roller 35 and bottom guide roller 30 allow a broader array of mounting options for the media supply roll 28. For example, structuring the media transport assembly 20 to include a top guide roller 35 allows for positioning of the media supply roll 28 above the media transport assembly 20 as shown in FIG. 3. Alternatively, structuring the media transport assembly 20 to include a bottom guide roller 30 allows for positioning of the media supply roll 28 below the media transport assembly 20 as shown in FIG. 4. In each embodiment, the media 25 is drawn from the media supply roll 28 and around the top guide roller 35 or the bottom guide roller 30 and into the media transport assembly 20 as shown. Accordingly, in embodiments having top and bottom guide rollers 35, 30, designers and/or installers of printers are afforded great flexibility when positioning the media supply roll 28.

Optionally, media may be configured in a fan-fold (i.e., stacked, folded continuous media) in which media may be drawn in to the media transport assembly 20 from a stack. Such media may be used, for example in airport boarding passes. In such an embodiment, both the bottom guide roller 30 and the top guide roller 35 may be engaged by the media as it is received by the media transport assembly 20.

Figure 5:
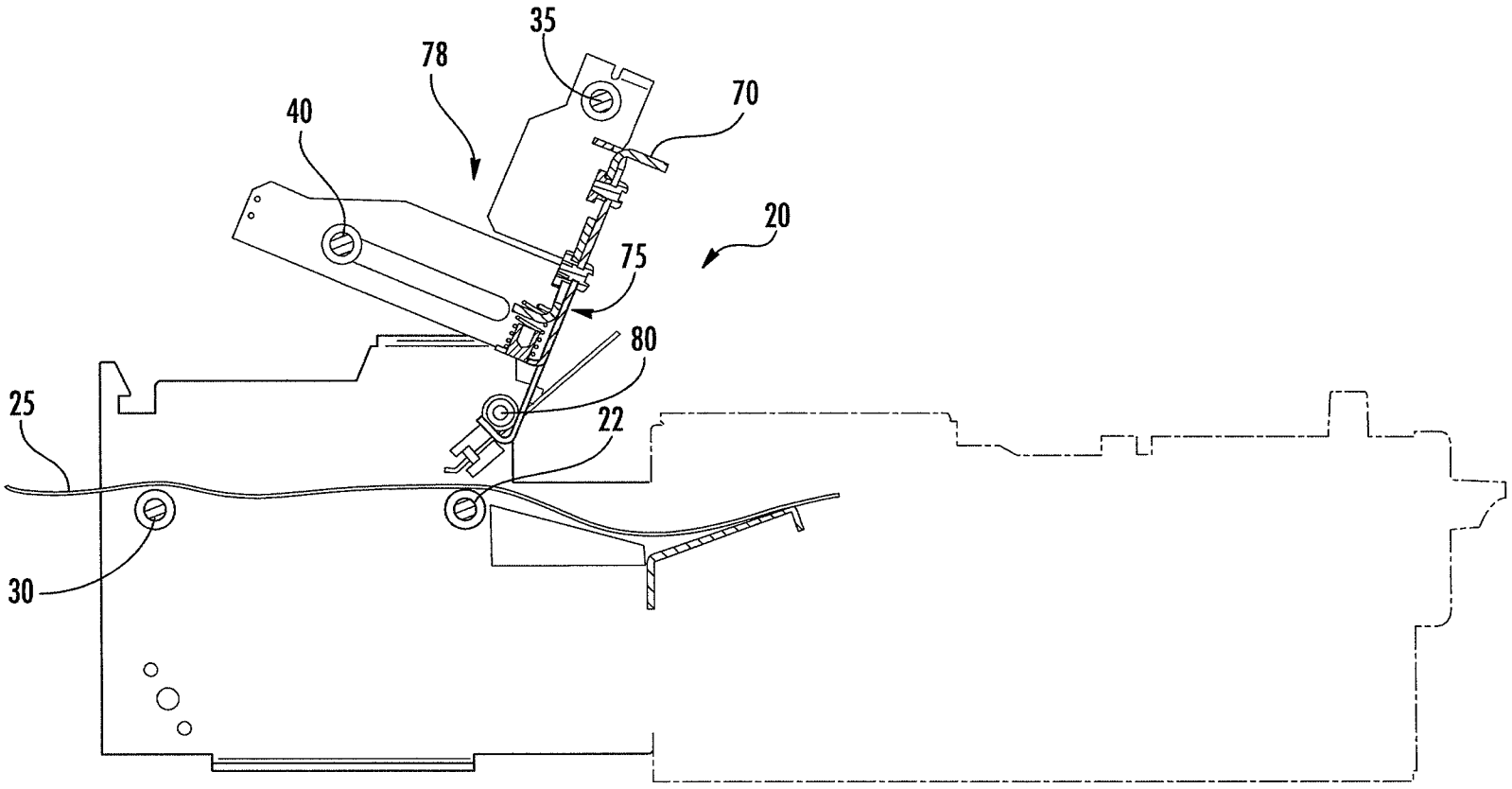
FIG. 5 is section view of a media transport assembly of the printer of FIG. 1, taken along section line AA of FIG. 1, wherein a hinged access assembly of the media transport assembly is illustrated in an open position in accordance with one embodiment discussed herein.
Figure 6:
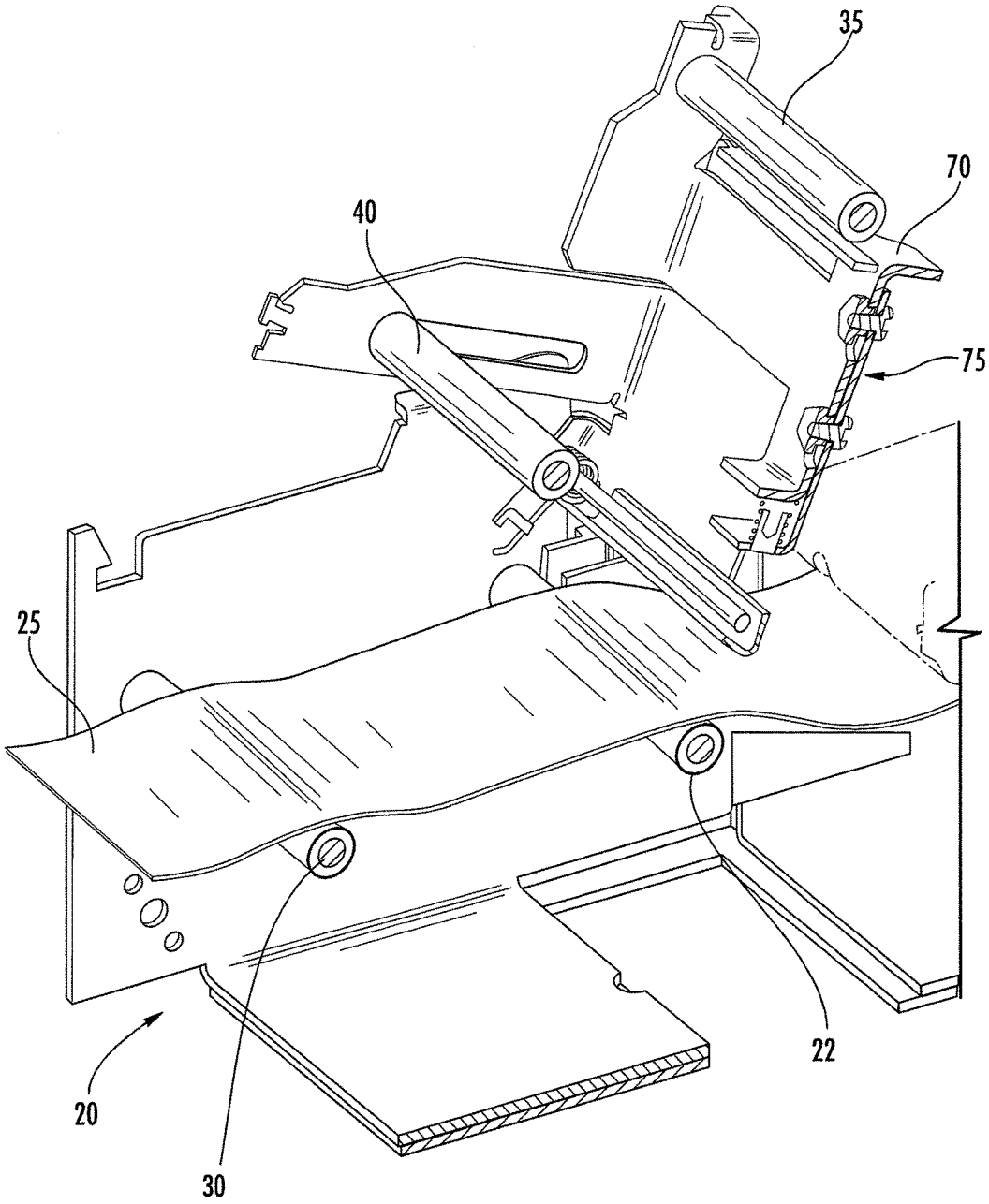
FIG. 6 is a perspective section view of the media transport assembly and media transport assembly depicted in FIG. 5.

FIGS. 5 and 6 illustrate yet another embodiment of the present invention that allows for easy loading and threading of media 25 into and through the media transport assembly 20. In addition to the guide rollers discussed above, the media transport assembly 20 may comprise a hinged access assembly 75 that is mounted to the printer 100 (e.g., frame, housing, etc.) via a hinge 80 as shown. In one embodiment, the hinged access assembly 75 is configured to rotate about the hinge 80 from a closed position shown in FIGS. 2A-4 to an open position shown in FIGS. 5-6. In one embodiment, a handle or tab 70 may be provided for grasping by a user when moving the hinged access assembly 75 to the open position. In some embodiments, a latch or lock mechanism may be provided to secure the hinged access assembly 75 in the closed position. For example, in one embodiment, pushing the tab 70 along the direction of arrow B in FIG. 2A may operate to unlock the latch mechanism thereby facilitating opening of the hinged access assembly 75.

The depicted hinged access assembly 75 supports (via a bracket, frame or other means) the upper guider roller 35 and the biased guide roller 40 as shown. The hinged access assembly 75 is thus structured to provide for easy media loading and threading by users. For example, in reference to FIGS. 5 and 6, a user need only draw the media 25 generally linearly over the bottom guide roller 30 and the stationary roller 22 when loading as the top guide roller 35 and the biased guider roller 40 have been rotated out of the way during opening of the hinged access assembly 75. The leading edge of the media 25 may then be fed to the printing assembly 15 and the hinged access assembly 75 may simply be closed to properly position the top guide roller 35 and the biased guide roller 40. Notably, and in contrast to prior art media transport assemblies, users need not thread the media through complex or serpentine conveyance paths in order to properly load the media.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A media transport assembly configured to transport media under a tension load along a media feed path, the media transport assembly comprising:

a stationary guide roller;

a bottom guide roller; and a hinged access assembly that is rotatably mounted to a hinge and movable between an open position and a closed position, wherein the hinged access assembly comprises a biased guide roller that is configured to apply a biasing force to the media away from the stationary guide roller when the hinged access assembly is disposed in the closed position;

wherein:

the biased guide roller is movable closer to the stationary guide roller against the biasing force in response to variations in the tension load with the hinged access assembly disposed in the closed position;

the hinge is located downstream along the media feed path from the biased guide roller;

the biased guide roller is positioned between the bottom guide roller and the stationary guide roller along the media feed path in response to the hinged access assembly being disposed in the closed position; and the biased guide roller is moved along a linear biasing path defined by a linear slot in the hinged access assembly, wherein the biased guide roller is spaced apart from the media when the hinged access assembly is disposed in the open position, and the biased guide roller is in contact with the media when the hinged access assembly is disposed in the closed position.

2. The media transport assembly of claim 1, wherein the biased guide roller is displaced in a direction opposite the biasing force in response to an increase in tension of the media along the media feed path.

3. The media transport assembly of claim 1, wherein the hinge is upstream from a media processing assembly.

4. The media transport assembly of claim 1, wherein the hinged access assembly further comprises a top guide roller mounted to the hinged access assembly upstream of the biased guide roller.

5. The media transport assembly of claim 1, wherein the media feed path is defined between a top guide roller and the bottom guide roller, and the media is engaged on one side by the biased guide roller and on another side by the stationary guide roller.

6. The media transport assembly of claim 5, wherein the top guide roller is attached to the hinged access assembly and the bottom guide roller and the stationary guide roller are attached to a base member of the media transport assembly.

7. The media transport assembly of claim 6, wherein the media feed path is defined between the hinged access assembly and the base member.

8. A media transport assembly comprising:

a top guide roller positioned on a first side of a media feed path, wherein:

media is drawn along the media feed path from a media supply roll, the media supply roll being movable from a first position on the first side of the media feed path to a second position on a second side of the media feed path opposite the first side;

the top guide roller is configured to engage and direct the media along the media feed path from the media supply roll when the media supply roll is disposed in the first position; and the top guide roller is configured to not engage the media when the media supply roll is disposed in the second position and the media is under tension in the media feed path;

a bottom guide roller positioned on the second side of the media feed path, wherein:

the bottom guide roller is configured to engage and direct the media along the media feed path from the media supply roll when the media supply roll is disposed in the second position;

the bottom guide roller is configured to not engage the media when the media supply roll is disposed in the first position and the media is under tension in the media feed path;

a stationary roller disposed on the second side of the media feed path; and a biased guide roller mounted to a hinged access assembly that is movable between an open position and a closed position relative to a base member, the biased guide roller configured to apply a biasing force to the media away from the stationary roller with the hinged access assembly in the closed position, wherein the biased guide roller is moved toward the stationary roller against the biasing force in response to an increase in tension of the media with the hinged access assembly in the closed position, and wherein the biased guide roller is configured to be positioned between the bottom guide roller and the stationary roller along the media feed path in response to the hinged access assembly being disposed in the closed position, wherein the biased guide roller is moved along a linear biasing path defined by a slot in the hinged access assembly, wherein the slot is linear and perpendicular to the media feed path when the hinged access assembly is in the closed position.

9. The media transport assembly of claim 8, wherein the top guide roller is attached to the hinged access assembly and wherein the bottom guide roller is attached to the base member.

10. The media transport assembly of claim 8, wherein the biased guide roller is displaced in a direction opposite the biasing force in response to an increase in tension of the media along the media feed path.

11. The media transport assembly of claim 8, wherein a portion of the media extending from at least one of the top guide roller or the bottom guide roller to the stationary roller is not deflected by any rollers or guides in response to the hinged access assembly being disposed in the open position, and wherein the portion of the media extending between the bottom guide roller and the stationary roller is deflected by the biasing roller in response to the hinged access assembly being disposed in the closed position.

12. A media transport assembly configured to transport media along a media feed path under a tension load, the media transport assembly comprising:

a biased guide roller mounted to a hinged access assembly that is movable between an open position and a closed position relative to a base member, the biased guide roller configured to apply a biasing force to the media away from a stationary guide roller with the hinged access assembly in the closed position, wherein the biased guide roller is moved closer to the stationary guide roller against the biasing force in response to an increase of the tension load with the hinged access assembly in the closed position, and wherein the biased guide roller is a rotationally bidirectional non-driven roller;

a bottom guide roller disposed on a first side of the media feed path and attached to the base member; and a linear biasing element having a longitudinal length, wherein the biasing force is applied in a direction parallel to the longitudinal length, wherein:

the stationary guide roller is disposed on the first side of the media feed path and attached to the base member;

the biased guide roller is disposed on a second side of the media feed path opposite the first side, between the bottom guide roller and the stationary guide roller along the media feed path, in response to the hinged access assembly being disposed in the closed position;

the biased guide roller is engaged with the media when the hinged access assembly is in the closed position, and the biased guide roller is disengaged from the media when the hinged access assembly is moved from the closed position to the open position; and the biased guide roller is displaced linearly in a direction opposite the direction of the biasing force in response to an increase in tension of the media along the media feed path.

13. The media transport assembly of claim 12, further comprising a top guide roller positioned on the second side of the media feed path.

14. The media transport assembly of claim 12, wherein the media feed path defines substantially a U-shape when the biased guide roller is in a retracted position.

* * * * *